US005765499A

United States Patent [19]

McKenzie

[11] Patent Number: 5,765,499

[45] Date of Patent: Jun. 16, 1998

[54] HYDRO-THRUST CANOE

[76] Inventor: Marvin Ray McKenzie, 3034 Nottingham Way, Dothan, Ala. 36301

[21] Appl. No.: 531,001

[22] Filed: Sep. 20, 1995

[51] Int. Cl.[6] ..... B63B 35/71

[52] U.S. Cl. ..... 114/347; 114/153; 440/6; 440/68

[58] Field of Search ..... 114/347, 153; 440/68, 6, 38, 40, 43

[56] References Cited

U.S. PATENT DOCUMENTS

| | | | |
|---|---|---|---|
| 2,654,335 | 10/1953 | Ball | 440/6 |
| 3,601,344 | 8/1971 | Nourse | 248/4 |
| 3,823,684 | 7/1974 | Baggs | 440/43 |
| 3,865,335 | 2/1975 | Roller et al. | 248/4 |
| 3,918,666 | 11/1975 | Florian | 248/4 |
| 4,616,591 | 10/1986 | Minor | 114/347 |
| 5,137,249 | 8/1992 | Royster | 248/642 |
| 5,481,997 | 1/1996 | Arndt | 114/347 |

FOREIGN PATENT DOCUMENTS

| | | | |
|---|---|---|---|
| 405085471 | 4/1993 | Japan | 440/6 |

*Primary Examiner*—Sherman Basinger

[57] ABSTRACT

The present invention relates to a canoe that is propelled by a motor. The motor having a shaft and a propeller contained within a hydrodynamically designed housing. The housing further having an inlet and an outlet whereby when the propeller rotates producing thrust, water enters the inlet and is thrust outwardly from the outlet.

6 Claims, 3 Drawing Sheets

HYDRO-THRUST CANOE

BACKGROUND OF THE INVENTION

Field of the Invention

The present invention relates to hydro-thrust canoe. More particularly, the present invention relates to canoe having a power means whereby water is propelled utilizing an impeller having an inlet and outlet through which water is thrusted

Description of the Prior Art

Due to the desirability of propelling a canoe or other similar vessel by means of a motor, the numerous inventions have been made to attach boat engines to the hull of a canoe by virtue of brackets. To date, there have been no attempts known to incorporate a jet propulsion device having a hydrodynamically designed configuration which reduces drag when the canoe is under manual power utilizing a paddle. Furthermore, no canoes have a foot petal - rudder steering mechanism as described in the present invention.

Numerous innovations for motor propelled canoes have been provided in the prior art that are described as follows. Even though these innovations may be suitable for the specific individual purposes to which they address, they differ from the present invention as hereinafter contrasted.

In U.S. Pat. No. 4,616,591 Titled, FLOTATION, SPLASH LESS CANOE MOTOR MOUNT, invented by John M. Minor, an invention described in the specifications is a canoe motor mount having a floatation body and spray rail attached forward of a transom board. The flotation body is 26 inches long by 12 inches wide by 9 inches deep and is constructed of 4 plies of fiberglass lamination (it may also be constructed of injection molded plastic or stamped aluminum). The transom board is 10 inches wide by 11 inches deep and is cut from ¾ inch exterior plywood. The claim is made that the use of a flotation body and spray rail is a unique improvement to existing art. Existing art is typified by the transom board shown in the drawing.

In U.S. Pat. No. 5,137,249, Titled, OUTBOARD MOTOR MOUNT FOR CANOE, Invented by, James N. Royster, a motor mounting assembly for canoes and the like includes a clamping assembly extends athwart ships at a point forwardly of the stern with a support member with end portions adapted to extend over and outwardly of the sides of the canoe, a clamping member adapted to engage under the gunwales of the canoe, and adjustable fasteners and to releasably draw the members together to clamp them to the canoe. At its aft end a transom mounting member extends generally in a vertical direction along the stem of the canoe and is adapted to support an outboard motor on its upper end. A pair of adjustable arms are secured to the support member of the clamping assembly and to the transom mounting member. A stabilizer is engaged with the transom mounting member and to the stern of the canoe. Adjustable arm stabilizers interconnect the arms intermediate their length and rigidify the assembly.

In U.S. Pat. No. 3,865,335, Titled, BOW BRACKET MOUNTING FOR AN ELECTRIC TROLLING MOTOR, invented by, Roller et al., describes a bracket for an electric trolling motor to be mounted on the bow of a fishing boat. The bracket includes a base member having a pair of upstanding C-shaped members on the forward end thereof. A pivot arm is hinged at the rear of the base and is equipped at the forward end with a trolling motor shaft holding bracket which is hinged for limited pivotal movement with respect to the arm. A remotely releasable latch is mounted on the forward end of the arm to lock the motor shaft in an operating position, but is releasable to permit movement of the trolling motor to a storage position wherein the motor shaft is horizontally disposed and the motor and prop unit is received by said C-members. In the storage position, a locking bolt eliminates movement of said arm relative to the operating position, a toggle biases the arm to engagement with the base.

In U.S. Pat. No. 3,918,666, Titled, CANOE BRACKET, Invented by, Nathaniel Florian, describes a bracket for mounting outboard motors on canoes which comprises an adjustable elongated V-shaped frame and resilient cup shaped members for engaging sides and top deck of a canoe. Each of said members being individually adjustable and a horizontal tail support for a motor to mount semi in operative position on the longitudinal axis of the canoe.

In U.S. Pat. No. 3,601,344, Titled, CANOE MOTOR MOUNT, Invented by, Jack T. Norse, describes a canoe motor mount having a motor mount member positionable at the stern of the canoe and being held there by attachment means connected to the canoe. The motor mount member includes a V-shaped notch for resting the member downwardly onto the keel at the canoe stern. The attachment means includes a wedge-shaped portion which can be snugly disposed at the upper edges of the canoe sides and is for various sizes of canoes. Adjustable connectors are included in the attachment means and extend to the motor mount member so that the motor mount member and the wedge-shaped portion can both be in snug contact with the canoe. This renders the entire structure adaptable to canoes of different sizes.

The above described patented inventions describe support structures in the form of mounting brackets for use in propelling canoes by a standard outboard motor. Mounting brackets drastically alter the aesthetic appearance of the canoe as well as weight distribution and cause drag. In addition, the brackets make the canoe instable as well as impede the canoe from crossing logs, and ricks when in use. Furthermore, the mounting rackets amplify noise and vibration which is detrimental to fishing as well as resulting in structural cracks in the hull of the canoe.

Numerous innovations for motor propelled canoes have been provided in the prior art that are adapted to be used. Even though these innovations may be suitable for the specific individual purposes to which they address, they would not be suitable for the purposes of the present invention as heretofore described.

SUMMARY OF THE INVENTION

The present invention describes a jet powered canoe which is basically silent and vibration free without limiting the canoe's performance. A small light weight hydrothruster is incorporated into a housing located at the stern of the canoe. The hydrothruster is incorporated in such a way utilizing vibration dampening means to reduce vibration to the canoe and noise emanating therefrom. The housing is hydrodynamically designed to reduce drag such that the canoe will function normally when manually powered by a paddle rather than the motor.

Utilizing the powered canoe, a person may enjoy all of the excitement of canoeing without fatigue as well as trolling for fish. Steering may be controlled by the paddle and/or an additional rudder-petal device may be utilized.

The types of problems encountered in the prior art are support structures in the form of mounting brackets for use in propelling canoes by a standard outboard motor. Mounting brackets drastically alter the aesthetic appearance of the canoe as well as weight distribution and cause drag. In addition, the brackets make the canoe instable as well as impede the canoe from crossing logs, and ricks when in use. Furthermore, the mounting rackets amplify noise and vibration which is detrimental to fishing as well as resulting in structural cracks in the hull of the canoe.

In the prior art, unsucessful attempts to solve this problem were attempted namely: producing various mounting brackets to hold standard motors onto a canoe hull. However, the problem was solved by the present invention because a new motor incorporated into a hydrodynamically designed housing is employed.

Innovations within the prior art are rapidly being exploited to propel canoes as well as other small vessels by utilizing mounting brackets.

The present invention went contrary to the teaching of the art which previously describes mounting brackets to attach standard engines to a canoe hull.

The present invention solved a long felt need if a powered canoe being silent and vibration free without limiting the canoe's performance.

The present invention produced unexpected results namely: vibration reduction and ability to cross over logs and other impediments without adversely affecting the canoe or the hydro-thrust due to the propulsion and steering means enclosed within the housing.

A synergistic effect was produced utilizing the present invention due to the following facts and results from experimentation: the hydro-thrust housing could be designed to add lift to the stern of the canoe and thereby making the canoe shape a faster hull.

Accordingly, it is an object of the present invention to provide a hydrodynamically designed housing having a housing inlet and a housing outlet through which the water enters and is thrusted rearwardly resulting in propulsion of the canoe.

More particularly, it is an object of the present invention to provide hydrodynamically designed housing which conforms to the lateral lines of the canoe hull and thus, reduces drag.

In keeping with these objects, and with others which will become apparent hereinafter, one feature of the present invention resides, briefly stated, in the motor having a motor shaft and a motor propeller securely fastened thereto. The motor may be positioned inside the housing, the motor shaft and the motor propeller are also housed within the housing. The motor is electrical.

When the hydro-thrust canoe is designed in accordance with the present invention, a rudder-pedal steering means consisting of a rudder blade contained within the housing, a rudder blade steering means contained within the canoe, a rudder blade steering means port cable, a rudder blade steering means starboard cable, a rudder pedal, a rudder port pedal, a rudder starboard pedal, a rudder pivot pin, and a rudder blade steering means pivot mount may be utilized as a steering means. However, since a user can steer the canoe with the use of a paddle, the steering means is not necessary to utilize the rudder-pedal system.

In accordance with another feature of the present invention, the hydro-thrust canoe has an electric motor further comprises a battery having a battery positive lead and a battery negative lead.

Another feature of the present invention is that the hydro-thrust canoe has a canoe hull is manufactured from a group of materials consisting of metal, metal alloy, fiberglass, epoxy, carbon-graphite, plastic, plastic composites and wood.

Yet another feature of the present invention is that the hydro-thrust canoe has a housing manufactured from a group of materials consisting of metal, metal alloy, fiberglass, epoxy, carbon-graphite, plastic, plastic composites and wood.

Still another feature of the present invention is that the hydro-thrust canoe has a rudder, rudder blade, rudder blade steering means, rudder blade steering means port cable, rudder blade steering means starboard cable, rudder pedal, rudder port pedal, rudder starboard pedal, rudder pivot pin, and rudder blade steering means pivot mount is manufactured from a non-corrosive material.

Yet still another feature of the present invention is that the hydro-thrust canoe has a rudder, rudder blade, rudder blade steering means, rudder blade steering means port cable, rudder blade steering means starboard cable, rudder pedal, rudder port pedal rudder starboard pedal, rudder pivot pin, and rudder blade steering means pivot mount is manufactured from a group of materials consisting of metal, metal alloy, fiberglass, epoxy, carbon-graphite, plastic, plastic composites and wood.

Still yet another feature of the present invention is that rudder pedal can pivot in a forward direction in resulting in acceleration or deceleration of the motor if a throttle cable is attached at to the top of the rudder pedal and concurrently, the rudder pedal can pivot in a frontward and rearward direction as well as forward and rearward on the left and right side which controls steering as described in detail herein.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10 - hydro-thrust canoe 10
12 - housing 12
12A - housing inlet 12A
12B - housing outlet 12B
14 - motor 14
14A - motor shaft 14A
14B - motor propeller 14B
16 - rudder 16
16A - rudder blade 16A
16B - rudder blade steering means 16B
16BA - rudder blade steering means port cable 16BA
16BB - rudder blade steering means starboard cable 16BB
16C - rudder pedal 16C
16CA - rudder port pedal 16CA
16CB - rudder starboard pedal 16CB
16CC - rudder pivot pin 16CC
16D - rudder blade steering means pivot mount 16D
18 - canoe 18
20 - boatsman 20

22 - oar 22

24 - fishing rod 24

26 - battery 26

26A - battery positive lead 26A

26B - battery negative lead 26B

BRIEF DESCRIPTION OF THE PREFERRED EMBODIMENT

DETAILED DESCRIPTION OF THE PREFERRED EMBODIMENT

Figure 1:
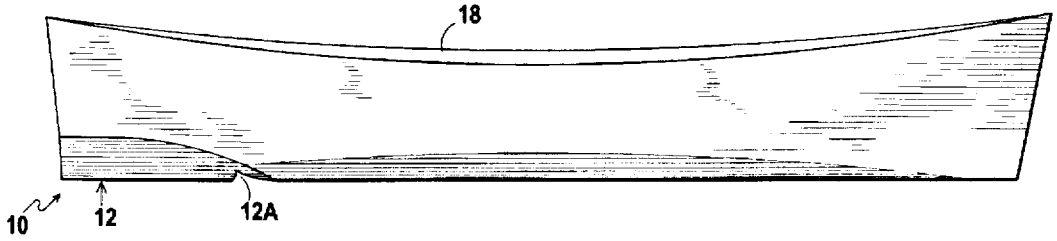
FIG. 1 is a side view of the hydro-thrust canoe.

Firstly referring to FIG. 1 which is a side view of the hydro-thrust canoe 10. At the lower rear stern is positioned the housing 12 which has a housing inlet 12A located at the front and a housing outlet 12B located at the rear. Positioned behind the housing outlet 12B is the rudder 16 which is utilized for manual steering by a user's feet upon the rudder pedal 16C.

Figure 1A:
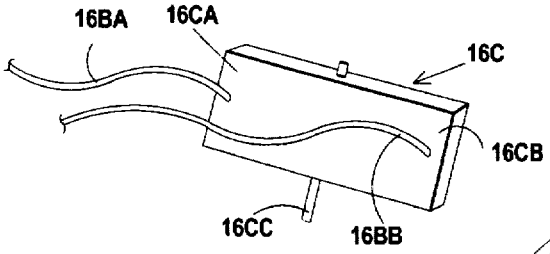
FIG. 1A is an enlarged view of the rudder petal.

Now referring to FIG. 1A which is an enlarged view of the rudder pedal 16C. The rudder pedal 16C has a rudder port pedal 16CA and a rudder starboard pedal 16CB which are pivotally mounted to a bottom of a hydro-thrust canoe 10 by the rudder pivot pin 16CC. When a user presses his or her foot on the rudder port pedal 16CA the rudder pedal pivots forward on the port side pulling with it the rudder blade steering means port cable 16BA which is attached at a rear distal end to the port side of the rudder blade steering means 16B and, thus, turns the rudder blade 16A and the hydro-thrust canoe in a port direction. Alternatively, when a user presses his or her foot on the rudder starboard pedal 16CB the rudder pedal pivots forward on the starboard side pulling with it the rudder blade steering means starboard cable 16BB which is attached at a rear distal end to the starboard side of the rudder blade steering means 16B and ,thus, turns the rudder blade 16A and the hydro-thrust canoe in a starboard direction.

Figure 2:
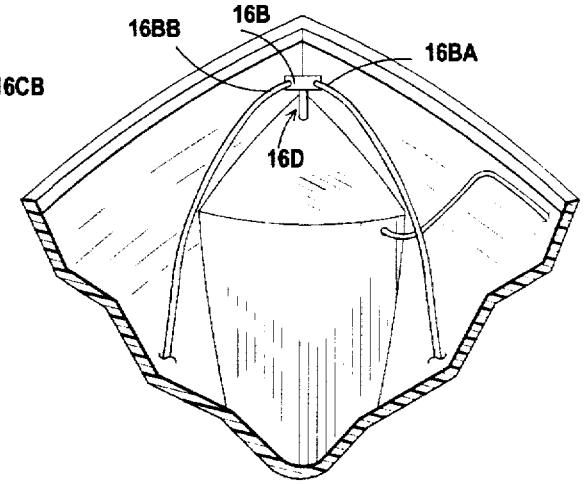
FIG. 2 is a rearward view from inside of the hydro-thrust canoe.

Referring now to FIG. 2 which is a rearward view from inside of the hydro-thrust canoe 10. The rudder 16 is a through hull component with a rudder blade steering means 16B having a rudder blade steering means port cable 16BA and a rudder blade steering means starboard cable 16BB attached thereto on the inside of the hydro-thrust canoe 10. The rudder blade steering means port cable 16BA and a rudder blade steering means starboard cable 16BB are connected to the rudder port pedal 16CA and the rudder starboard pedal 16CB, respectively.

Figure 2A:
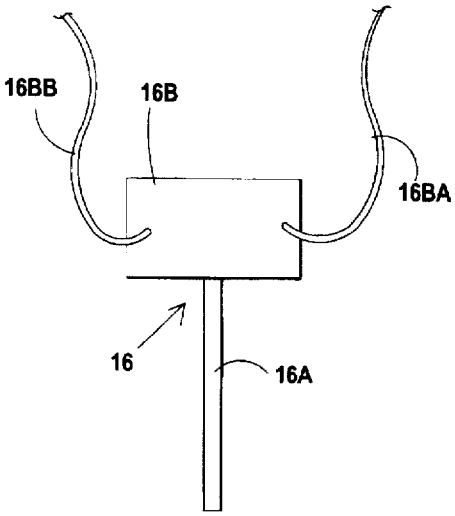
FIG. 2A is an enlarged front view of the rudder.

Referring to FIG. 2A which is an enlarged front view of the rudder 16. The rudder blade 16A is securely fastened to the rudder blade steering means 16B which is pivotally securely mounted by the rudder blade steering means pivot mount 16D on the stern of the hydro-thrust canoe 10. The rudder blade steering means port cable 16BA is securely fastened on a the port side of the rudder blade steering means 16B and the rudder blade steering means starboard cable 16BB is securely fastened on the starboard side of the rudder blade steering means 16B. When the rudder blade steering means port cable 16BA is pulled in a forward direction, concurrently the rudder blade steering means 16B and the rudder blade 16A are pivoted in a port direction and thus, the hydro-canoe steers to the port. Oppositely, when the rudder blade steering means starboard cable 16BB is pulled in a forward direction, concurrently the rudder blade steering means 16B and the rudder blade 16A are pivoted in a starboard direction and thus, the hydro-canoe steers to the starboard.

Figure 2B:
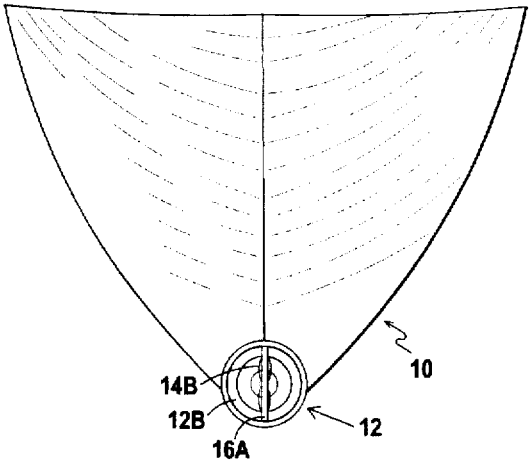
FIG. 2B is rear view of the hydro-thrust canoe.

Referring to FIG. 2B which is rear view of the hydro-thrust canoe 10. Notice how the motor propeller 14B and the rudder blade 16A are all contained within housing outlet 12B of housing 12. The primary function to contain the motor propeller 14B and the rudder blade 16A inside of the housing 12 is to prevent damage thereto when the hydro-thrust canoe goes over water obstacles such as logs and rocks. It also aids in the hydrodynamic streamlining of the hydro-thrust canoe.

Figure 4:
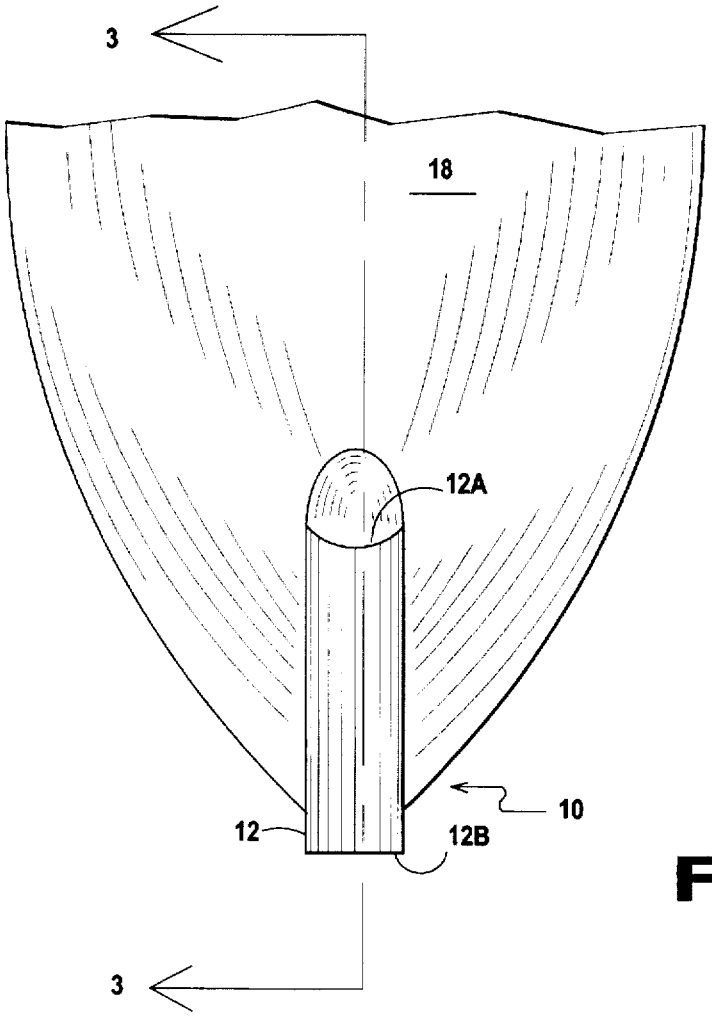
FIG. 4 is a bottom view of the hydro-thrust canoe.
Figure 3:
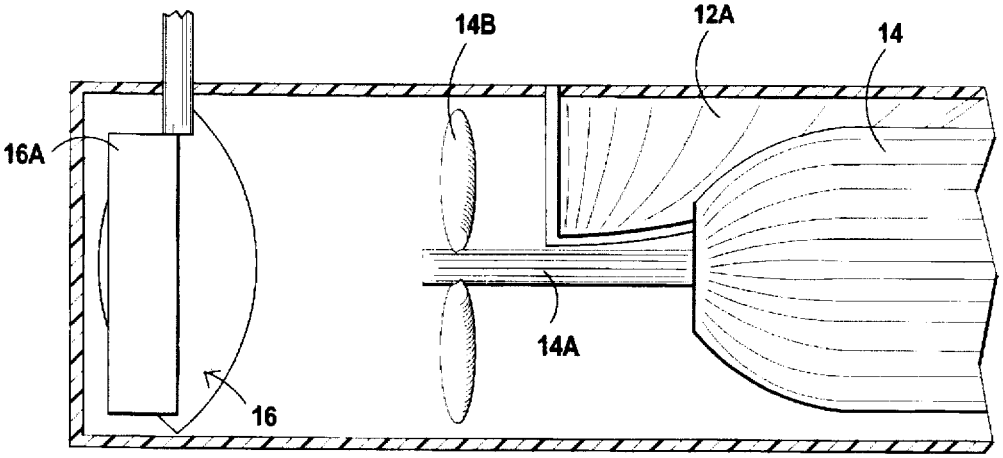
FIG. 3 is a cross-sectional view of the housing and motor along axis 3—3 of FIG. 4.

Referring now to FIG. 3 which is a cross-sectional view of the housing and motor along axis 3—3 of FIG. 4. The cylindrical shape of the housing 12 is hydrodynamically designed to conform to the lateral lines of the hull shape of the hydro-thrust canoe 10. The hydrodynamic design functions to reduce drag. Contained within the housing 12 is the motor 14 having a motor shaft 14A and a motor propeller 14B. When the motor 14 is activated the propeller spins causing thrust of water out from the housing outlet 12B and concurrently water intake into the housing inlet 12A, thus, propelling the hydro-thrust canoe 10 in a forward direction. The motor 14 can be electric and powered by a battery 26 having a battery positive lead 26A and a battery negative lead 26B electrically connected to the motor 14. Alternatively, the motor 14 may be a combustible engine.

Now referring to FIG. 4 which is a bottom view of the hydro-thrust canoe 10. The housing 12 is hydrodynamically designed in a cylindrical configuration such that when the motor 14 is not functioning, water only minimally enters the housing inlet 12A due to it's scalloped opening shape in conjunction with the lateral line of the hull of the hydro-thrust canoe 10. This hydrodynamic feature permits the user to manually paddle 22 and manually steer the hydro-thrust canoe 10 with the minimum amount of drag.

Figure 5:
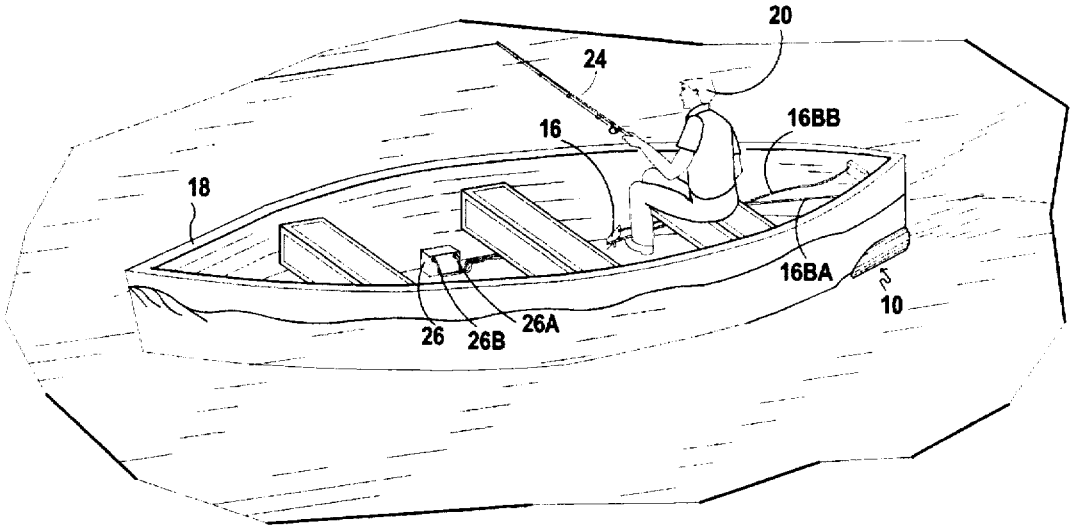
FIG. 5 is a perspective view of the hydro-thrust canoe being motor propelled and steered by the rudder pedal.
Figure 6:
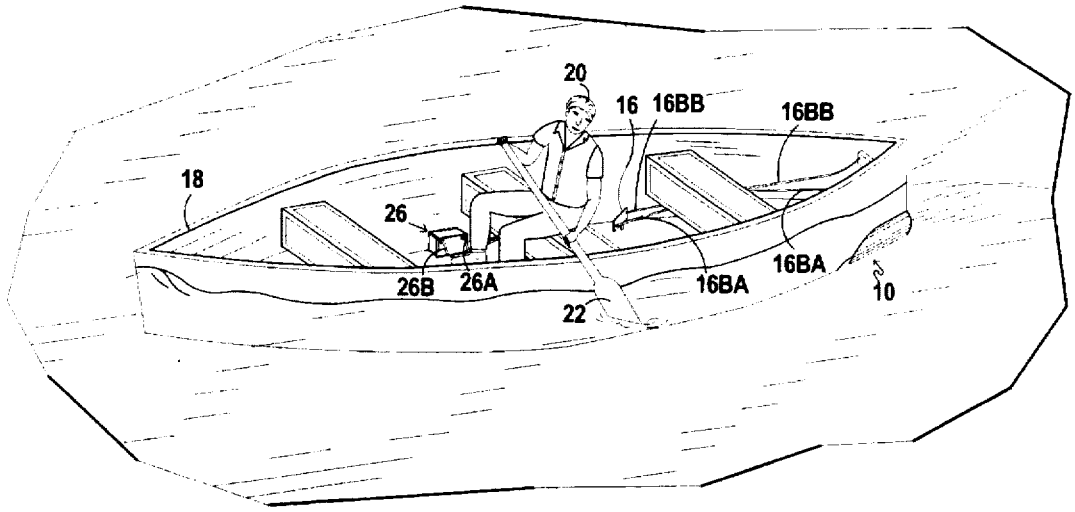
FIG. 6 is a perspective view of the hydro-thrust canoe being manually propelled by a paddle and also steered by the paddle.

Referring to FIGS. 5 and 6 which are a perspective view of the hydrothrust canoe 10 being motor 14 propelled and steered by the rudder pedal 16 and a perspective view of the hydro-thrust canoe 10 being manually propelled by a paddle and also steered by the paddle 22, respectively. The user 20 can steer the hydro-thrust canoe 10 by the rudder pedal 16C. In an alternative embodiment (NOT SHOWN), the rudder pedal 16C could be made to pivot port and starboard for steering and also forward and backward to control speed of the motor 14 and concurrently speed of the hydro-thrust canoe 10. By utilizing the hydro-thrust canoe 10, the user 20 can troll with a fishing rod 24 covering larger distances on a body of water than manually utilizing a paddle 22. On other feature of the hydro-thrust canoe 10 having a hydro-dynamically shaped housing 12 is that if the motor 14 runs out of power (battery 26 and or fuel in a combustible engine), the user 20 can easily manually paddle the hydro-thrust canoe 10 with minimal drag and concurrently help his or her steering utilizing the rudder pedal 16C and concurrently the rudder 16.

It will be understood that each of the elements described above, or two or more together, may also fmd a useful application in other types of constructions differing from the type described above.

While the invention has been illustrated and described as embodied in a hydrothrust canoe, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hydro-thrust canoe (10) comprising:

A) a canoe hull;

B) a housing (12) which comprises a housing inlet (12A) and a housing outlet (12B), the housing (12) is securely attached to a bottom-rear distal end of the canoe hull;

C) a motor (14) contained within the housing, the motor (14) comprises a motor shaft (14A) rotatably attached thereto, the motor shaft (14A) having a motor propeller (14B) securely attached thereto, the motor shaft (14A) and the motor propeller (14B) contained with the housing;

D) a rudder (16) pivotally mounted in the housing (12), a rudder blade steering means pivot mount (16D) for mounting the rudder (16) within the housing, the rudder (16) comprises a rudder blade (16A) securely connected to a rudder blade steering means (16B) having a rudder blade steering means port cable (16BA) and a rudder blade steering means starboard cable (16BB) each securely attached at a rear distal end thereto, a front distal end of the rudder blade steering means port cable (16BA) is securely fastened to a rudder port pedal (16CA) of a rudder pedal (16C) and a front distal end of the rudder blade steering means starboard cable (16BB) is securely fastened to a rudder starboard pedal (16CB) of the rudder pedal (16C) which further comprises a rudder pivot pin (16CC) rotatably mounted in the canoe hull, the rudder (16) is manufactured from a non-corrosive material.

2. The hydro-thrust canoe (10) as described in claim 1, wherein the motor is an electric motor.

3. The hydro-thrust canoe (10) as described in claim 2, wherein the electric motor is powered by a battery (26) having a battery positive lead (26A) and a battery negative lead (26B) attached thereto.

4. The hydro-thrust canoe (10) as described in claim 3, wherein the rudder (16) is manufactured from a group of materials consisting of metal, metal alloy, fiberglass, epoxy, carbon-graphite, plastic, plastic composites and wood.

5. The hydro-thrust canoe (10) as described in claim 1, wherein the canoe hull is manufactured from a group of materials consisting of metal, metal alloy, fiberglass, epoxy, carbongraphite, plastic, plastic composites and wood.

6. The hydro-thrust canoe (10) as described in claim 1, wherein the housing (12) is manufactured from a group of materials consisting of metal, metal alloy, fiberglass, epoxy, carbon-graphite, plastic, plastic composites and wood.

* * * * *